US007291073B2

(12) United States Patent
Park

(10) Patent No.: US 7,291,073 B2
(45) Date of Patent: Nov. 6, 2007

(54) GOLF CLUB HEAD HAVING A VARIABLE LOFT ANGLE

(75) Inventor: Byeong Yeol Park, Gyeonggi-do (KR)

(73) Assignee: Nine & Nine Co., Ltd. (KR)

( * ) Notice: Subject to any disclaimer, the term of this patent is extended or adjusted under 35 U.S.C. 154(b) by 203 days.

(21) Appl. No.: 11/152,120

(22) Filed: Jun. 14, 2005

(65) Prior Publication Data

US 2006/0183564 A1 Aug. 17, 2006

(30) Foreign Application Priority Data

Feb. 14, 2005 (KR) ..... 10-2005-0011887

(51) Int. Cl.
*A63B 53/06* (2006.01)

(52) U.S. Cl. ..... 473/245

(58) Field of Classification Search ..... 473/245–247
See application file for complete search history.

(56) References Cited

U.S. PATENT DOCUMENTS 1,137,457 A * 4/1915 Breitenbaugh ..... 473/245

* cited by examiner

*Primary Examiner*—Stephen Blau
(74) *Attorney, Agent, or Firm*—Akerman Senterfitt

(57) ABSTRACT

The present invention discloses a golf club head having a variable loft angle that is designed to rotate thereby to allow selective variation of the loft angle of the club. The golf club head is connected to a shaft of a golf club and includes a head portion having a head body for striking a golf ball and a head heel extending upwardly from one side of the head body and bent at a given angle, and a fastening portion extending to the shaft and having a rotary assembly rotating with respect to the head portion and a fixing assembly for fixing the head portion to a position at which a given loft angle is selected.

13 Claims, 20 Drawing Sheets

GOLF CLUB HEAD HAVING A VARIABLE LOFT ANGLE

BACKGROUND OF THE INVENTION

1. Field of the Invention

The present invention relates to a golf club head having a variable loft angle, and more particularly, to a golf club head having a variable loft angle that is designed to rotate thereby to allow selective variation of the loft angle of the club.

2. Background of the Related Art

There are no technical ideas related in the present invention that are conventionally known and therefore, an explanation of problems appearing in conventional golf clubs is given hereinafter.

Golf clubs traditionally comprise a number of woods, drivers, a number of irons, wedges, and putters, and they have somewhat different loft angles, according to the designs of a variety of companies. Generally, drivers have loft angles ranged between 5° and 13°, and woods have them ranged between 13° and 15°. A No.2 iron has a loft angle of 19°, a No.3 iron has a loft angle of 22°, a No.4 iron has a loft angle of 25°, a No.5 iron has a loft angle of 28°, a No.6 iron has a loft angle of 32°, a No.7 iron has a loft angle of 36°, a No.8 iron has a loft angle of 40°, and a No.9 iron has a loft angle of 44°. On the other hand, a pitching wedge has a loft angle of 48°, an approach wedge has a loft angle of 52° or 53°, a sand wedge has a loft angle of 55° or 56°, and a lob wedge has a loft angle of 60°.

A loft angle of a golf club is determined between a vertical plane of 90° formed at the front of a club face with respect to the ground line extended from a sole located at the front of the club face when a sole of the golf club is placed on the ground and a slant plane formed along the middle portion of the club face at which hitting a golf ball is executed. The loft angle is one of important considerations required when the golf club hits the ball. Thus, when the loft angle is large, the golf ball travels high, having a relatively short distance, and contrarily, when it is small, the ball travels low, having a relatively long distance.

However, all of conventional golf clubs have only one loft angle that is not variable because the club heads are undetachably fixed to shafts of the golf clubs. Thus, golfers should carry a full set of golf clubs adequate for various usage purposes. It is however inconvenient to carry the full set of golf clubs that is not used well, and even though the golfer has the full set of golf clubs, it is also not easy to change the golf clubs with another whenever required.

SUMMARY OF THE INVENTION

Accordingly, the present invention has been made in view of the above-mentioned problems occurring in the prior art, and it is an object of the present invention is to provide a golf club head having a variable loft angle that is designed to rotate to thereby allow selective variation of the loft angle of the club. Another object of the present invention is to provide a golf club head having a variable loft angle that is designed such that the golf club head rotates, allowing the loft angle to selectively vary with ease.

To accomplish the above objects, according to the present invention, there is provided a golf club head having a variable loft angle, connected to a shaft of a golf club, the golf club head including: a head portion having a head body for striking a golf ball and a head heel extending upwardly from one side of the head body and bent at a given angle; and a fastening portion extending to the shaft and having a rotary assembly rotating with respect to the head portion and a fixing assembly for fixing the head portion to a position at which a given loft angle is selected.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

According to the present invention, there is provided a golf club head having a variable loft angle that is extended to a shaft of a golf club, the golf club head comprising: a head portion having a head body for striking a golf ball and a head heel extending upwardly from one side of the head body and bent at a given angle, and a fastening portion rotatably extending from the head portion.

Figure 1:
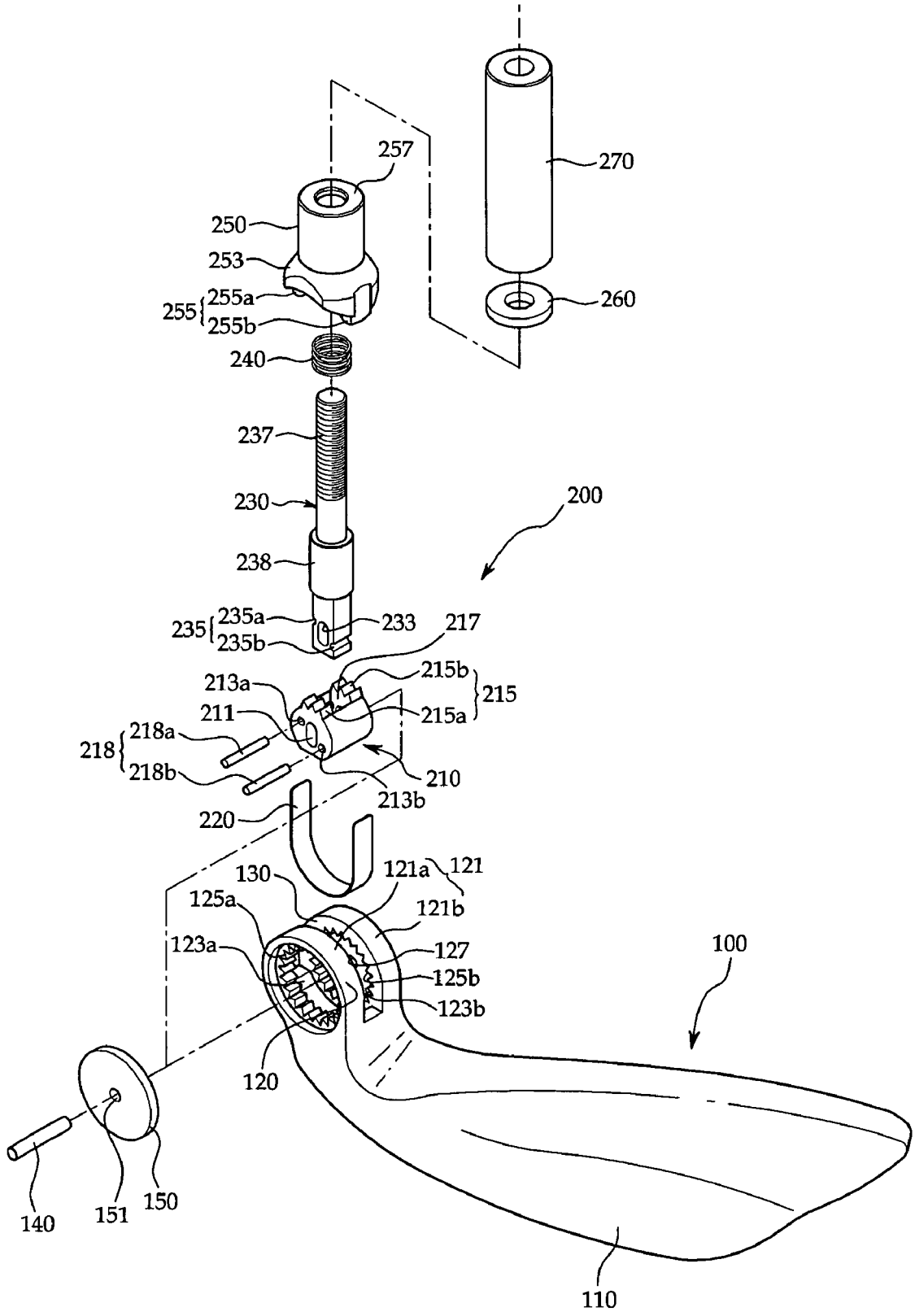
FIG. 1 is an exploded perspective view of a golf club head according to a first embodiment of the present invention.

Now, an explanation of the configuration of the golf club head according to a first embodiment of the present invention is given with reference to FIGS. 1 to 8. First, FIG. 1 is an exploded perspective view of a golf club head having a variable loft angle according to the first embodiment of the present invention. The golf club head includes a head portion 100 and a fastening portion 200 in which a rotary body 210, a protecting band 220, a fastening bar 230, a spring 240, a hollow fastening tube 250 and a washer 260 are located in appropriate relation to one another.

The head portion 100 has a head body 110 striking a golf ball and a head heel 120 bent at a given angle upwardly from one side of the body 110.

The body 110 has a variety of shapes in accordance with the kinds of golf clubs, for example, such as drivers, woods, irons, wedges, and putters. In the preferred embodiments of the present invention, the head body 110 is illustrated on a conventional wedge. However, as will be explained in more detail below, it should be understood that the present invention is not limited to use on the wedge and can be used on any conventional golf club.

The head heel 120 that is extended from the head body 110 is provided with a guide recess 130 that is extended to left and right directions from a central portion at an end portion thereof such that the end of the head heel 120 is separated into two parts forming a pair of head heel pieces 121*a* and 121*b*.

Figure 2:
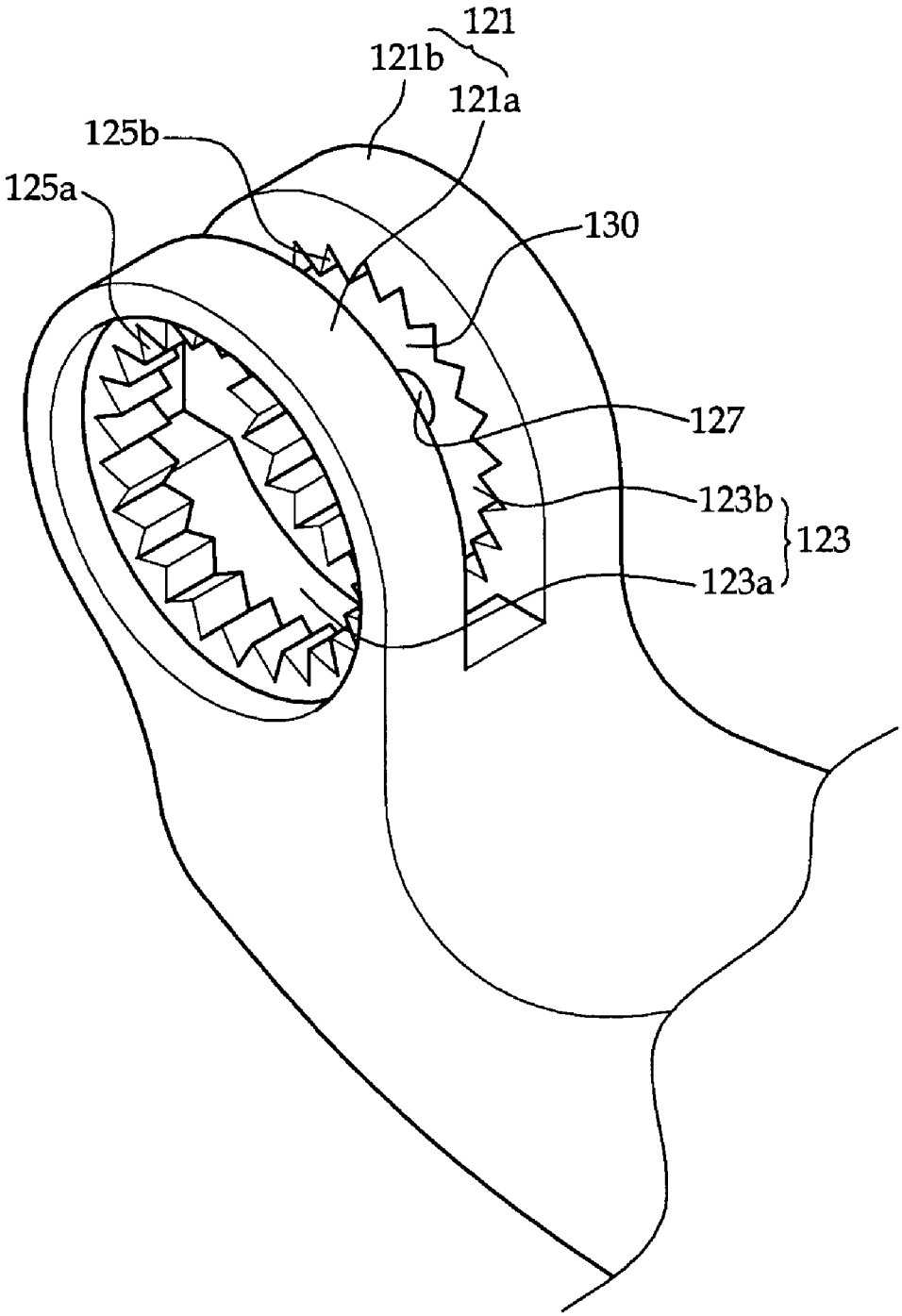
FIG. 2 is a cut perspective view of a head heel of the head portion of the golf club head of FIG. 1.

FIG. 2 is a cut perspective view of a head heel of the head portion of the golf club head of FIG. 1, in which the configuration of the head heel 120 is in detail illustrated. As shown in FIGS. 1 and 2, the guide recess 130 into which a rotary body 210 adapted to be coupled to the end portion of the fastening portion 200, as will be described below, is inserted such that the fastening portion 200 is turned along the extended direction of the guide recess 130. The pair of head heel pieces 121*a* and 121*b* are provided with a pair of rotary holes 123*a* and 123*b* that are adapted to mount the rotary body 210 therein, communicating with the guide recess 130, and a pair of inner gears 125*a* and 125*b* along outer peripheries thereof in such a manner as to be engaged with a pair of outer gear pieces 215*a* and 215*b* formed on the rotary body 210. At this time, the outer gear pieces 215*a* and 215*b* are operated in such a manner as to be engaged with the inner gears 125*a* and 125*b* or separated therefrom, and thus, the rotary holes 123*a* and 123*b* should be formed to occupy a space where the outer gear pieces 215*a* and 215*b* of the rotary body 210 are fully separated from the inner gears 125*a* and 125*b*.

On the other hand, the cover 150 is provided with a shaft hole 151 having a given diameter at the central portion thereof, and the head heel piece 121*b* that is not exposed to the outside is provided with a shaft hole 127 having the given diameter at the wall surface thereof, such that a shaft pin 140 is fittably passed through the shaft holes 151 and 127.

At this time, the end portions of the head heel pieces 121*a* and 121*b* are desirably rounded such that an end portion of the hollow fastening tube 250 located to the head heel 120 side is rounded concavely, facing the rounded end portions of the head heel pieces 121*a* and 121*b*, thereby making the fastening portion 200 smoothly rotated with respect to the head portion 100.

On the other hand, desirably, a device for protecting dusts and foreign materials from gathering into the guide recess 130 is disposed. In this preferred embodiment, the protecting band 220 that has a predetermined length is disposed in the guide recess 130, surrounding the outer peripheral surface of the rotary body 210 and connected to guide protrusions 255*a* and 255*b* of the hollow fastening tube 250 at both end portions thereof. At this time, the protecting band 220 is preferably connected seamlessly in a laser-welding manner to the guide protrusions 255*a* and 255*b*.

Also, the head heel 120 has the marks indicating the angles of the head portion 100 such that a desired loft angle can be easily selected by a golfer.

The fastening portion 200 includes the rotary body 210, the fastening bar 230, the hollow fastening tube 250, and the spring 240.

Figure 3:
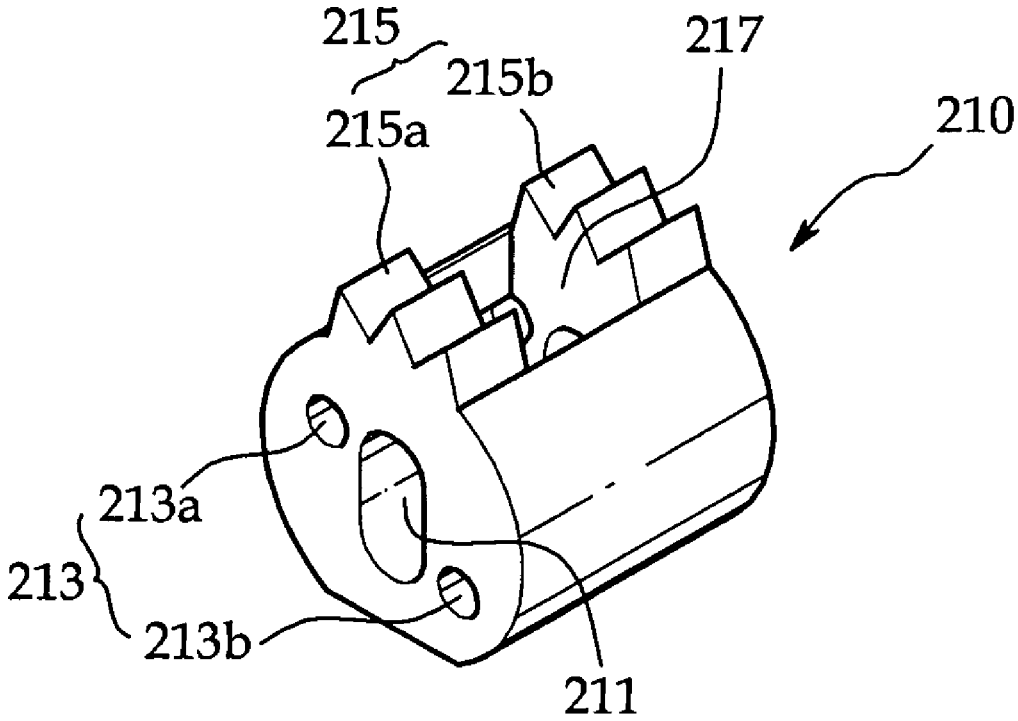
FIG. 3 is a perspective view of a rotary body of the golf club head of FIG. 1.

The rotary body 210 is a generally cylindrical body that is rotated in such a manner as to be inserted into the shaft pin 140. FIG. 3 is a perspective view of the rotary body 210 of the golf club head of FIG. 1. As shown in FIGS. 1 and 3, the rotary body 210 is provided with an insertion recess 217 that is formed on the top portion of an outer peripheral surface thereof, the pair of outer gear pieces 215*a* and 215*b* that are protruded at the both sides of the insertion recess 217, a first through hole 211 that is adapted to pass through the both end portions of the cylindrical rotary body 210, and fixing holes 213*a* and 213*b* that are adapted to fixedly connect the rotary body 210 with the end portion of the fastening bar 230 being inserted into the insertion recess 217.

The insertion recess 217 is formed to have a space where the square end portion of the fastening bar 230 is fittably inserted thereinto.

The pair of outer gear pieces 215*a* and 215*b* that are disposed at the both sides of the insertion recess 217 of the rotary body 210 serve as protrusions that are engaged with the inner gears 125*a* and 125*b*. It is possible to have the outer gear pieces 215*a* and 215*b* each having one protrusion, but in order to have the engagement of the outer gear pieces 215*a* and 215*b* with the inner gears 125*a* and 125*b* in more rigid relation with one another, it is preferable to have the outer gear pieces 215*a* and 215*b* each having two or more protrusions. In the preferred embodiment of the present invention, therefore, each of them has three protrusions.

The first through hole 211 through which the shaft pin 140 is passed is an elongated hole formed toward the outer gear pieces 215*a* and 215*b*, which allows the outer gear pieces 215*a* and 215*b* to be separated from the inner gears 125*a* and 125*b*. That is to say, the outer gear pieces 215*a* and 215*b* are separated from given grooves of the inner gears 125*a* and 125*b* and then rotated to a given angle. After that, they are fitted into another given grooves of the inner gears 125*a* and 125*b*.

In the preferred embodiment of the present invention, on the other hand, at least one or more fixing holes 213*a* and 213*b* through which fixing pins 218*a* and 218*b* are passed are formed in parallel relation with the first through hole 211, for coupling the rotary body 210 with the fastening bar 230 after the insertion end portion 231 of the fastening bar 230 is inserted into the insertion recess 217. At this time, however, the connection may be achieved by welding, without any fixing pins 218*a* and 218*b*.

The fastening bar 230 is inserted into the insertion recess 217 of the rotary body 210 for connection with the rotary body 210. The insertion end 231 of the rotary body 210 has a generally square shape, provided with an elongated second through hole 233 that has the same shape as the first through hole 211, through which the shaft pin 140 is passed, and with at least one or more fixing grooves 235*a* and 235*b* into which the fixing pins 218*a* and 218*b* are mounted.

The fastening bar 230 is provided with a male screw portion 237 on which a male screw is formed around the outer peripheral surface at the other end thereof. At this time, the male screw is desirably formed as a left-handed screw. That is to say, the male screw portion 237 is formed such that an adjusting tube 270 having a female screw as will be discussed below is rotated in a counter-clockwise direction to advance forwardly. This prevents the fastened screws from being loose even though a right-handed golfer conducts a swing with the golf club.

The fastening bar 230 is provided with the spring 240 that is disposed at a given position of the outer peripheral surface thereof, and in this case, the fastening bar 230 is provided with a spring fixing member 238 that is located at one section of the fastening bar body, for preventing the spring 240 from moving forwardly by a predetermined distance. In the preferred embodiment of the present invention, the spring fixing member 238 is configured to have a given diameter larger than the fastening bar 230 at the section where the spring 240 is disposed, but a variety of methods such as, for example, a method of integrally securing a round fixing ring to the fastening bar 230 can be carried out.

Figure 4:
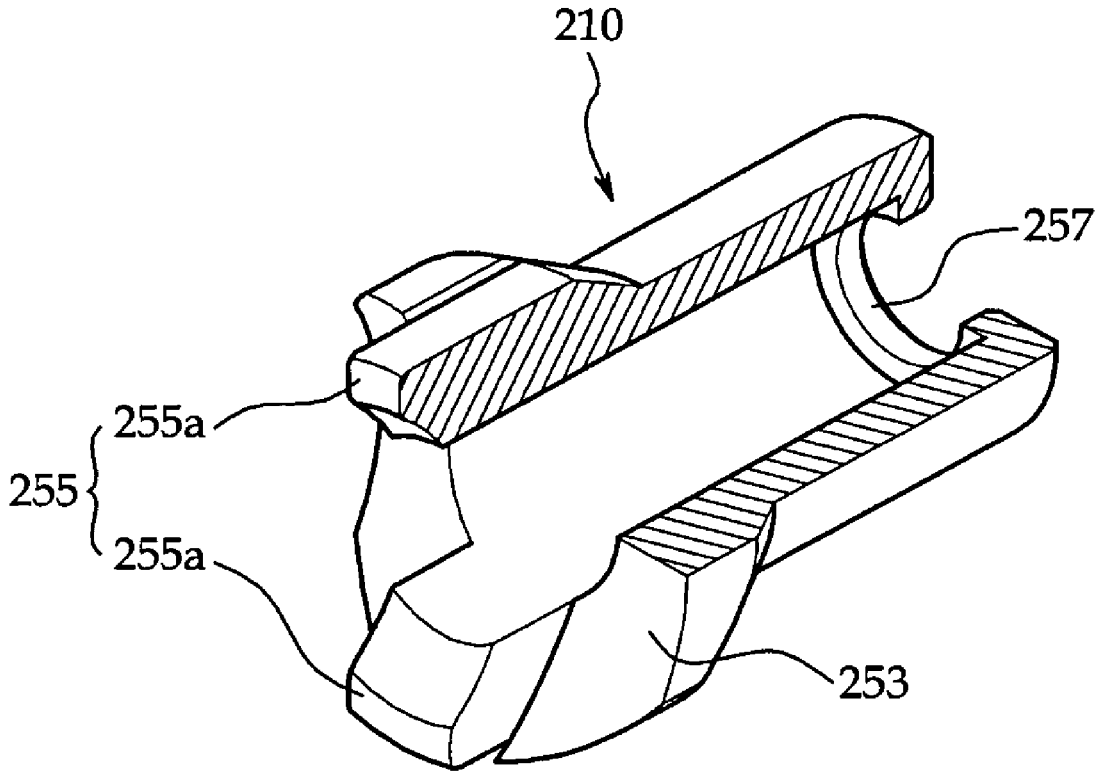
FIG. 4 is a cut perspective view of a hollow fastening tube of the golf club head of FIG. 1.

The fastening bar 230 has the hollow fastening tube 250 first disposed around the outer periphery thereof. FIG. 4 is a cut perspective view of the hollow fastening tube 250 of the golf club head of FIG. 1. As shown in FIGS. 1 and 4, the hollow fastening tube 250 is formed to have a shorter length than the fastening bar 230 such that the male screw of the fastening bar 230 is exposed by a given length to the outside, and also, the hollow fastening tube 250 is provided with the concave end portion 253 that is disposed to the head heel side and concavely rounded to fit into the round end portion of the head heel 120.

At that time, preferably, the hollow fastening tube 250 is provided with a pair of guide protrusions 255*a* and 255*b* that are fittably disposed to the guide recess 130 at one end portion thereof located to the head heel side, such that the fastening bar 230 can be rotated along the guide recess 130 in a more reliable manner.

On the other hand, the hollow fastening tube 250 is provided with a spring pressurizing member 257 that is disposed at an end portion thereof located to the adjusting tube 270 side in an opposite direction to the concave end portion 253 thereof located to the head heel side, for pressurizing the spring 240. The spring pressurizing member 257 is formed to apply the elasticity of spring 240 to the hollow fastening tube 250, irrespective of its shape, such that when the adjusting tube 270 is moved backwardly, the hollow fastening tube 250 is moved backwardly along the adjusting tube 270. In the preferred embodiment of the present invention, the spring pressurizing member 257 is formed of a pressurizing section that is made by reducing the diameter of the hollow of the end portion located to the adjusting tube 270 side of the fastening tube 250 and by increasing the thickness of the hollow fastening tube 250. The hollow fastening tube 250 is provided at the outer periphery thereof with the hollow adjusting tube 270 that is coupled with the fastening bar 230 in a screw-coupling manner. The adjusting tube 270 forms the female screw that is coupled to the male screw of the hollow fastening tube 250, along an inner periphery thereof at one section of the end portion thereof located to the fastening bar 230 side. Through the female screw, thus, the adjusting tube 270 is coupled to the male screw portion 237 of the fastening bar 230, and the adjusting tube 270 is connected to the shaft (not shown in the drawing) of the golf club at the other end portion thereof. In this case, a method for connecting the adjusting tube 270 to the shaft is known to those skilled in the art, and an explanation of it will be avoided for the brevity of the description.

On the other hand, preferably, there is provided the washer 260 between the adjusting tube 270 and the hollow fastening tube 250, for moving the adjusting tube 270 in a smoother manner.

Figure 5A:
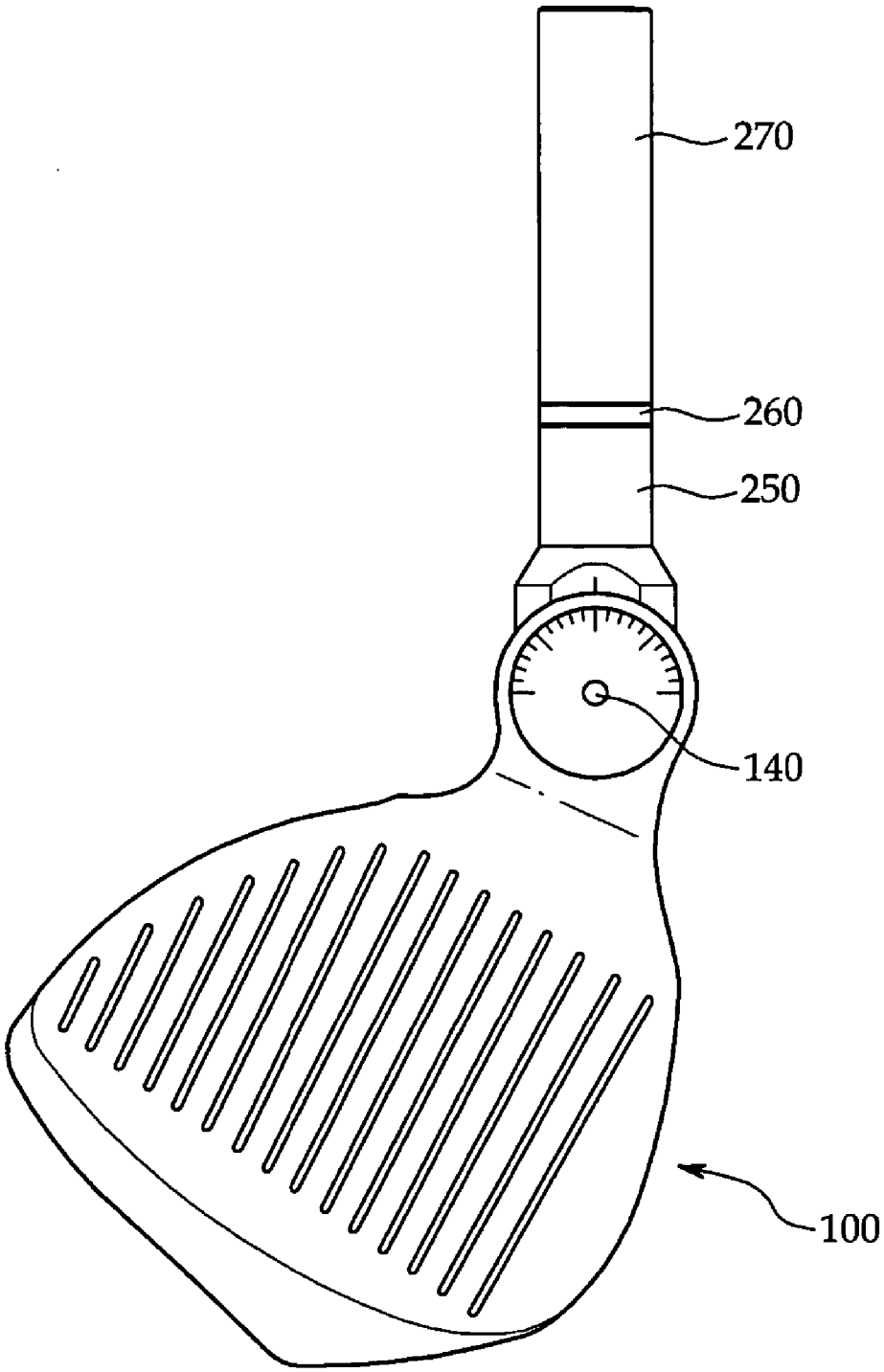
FIGS. 5*a* and 5*b* are partly cut sectional views showing an operation where the head portion is fixed at a given loft angle, in the golf club configured according to the first embodiment of the present invention.
Figure 5B:
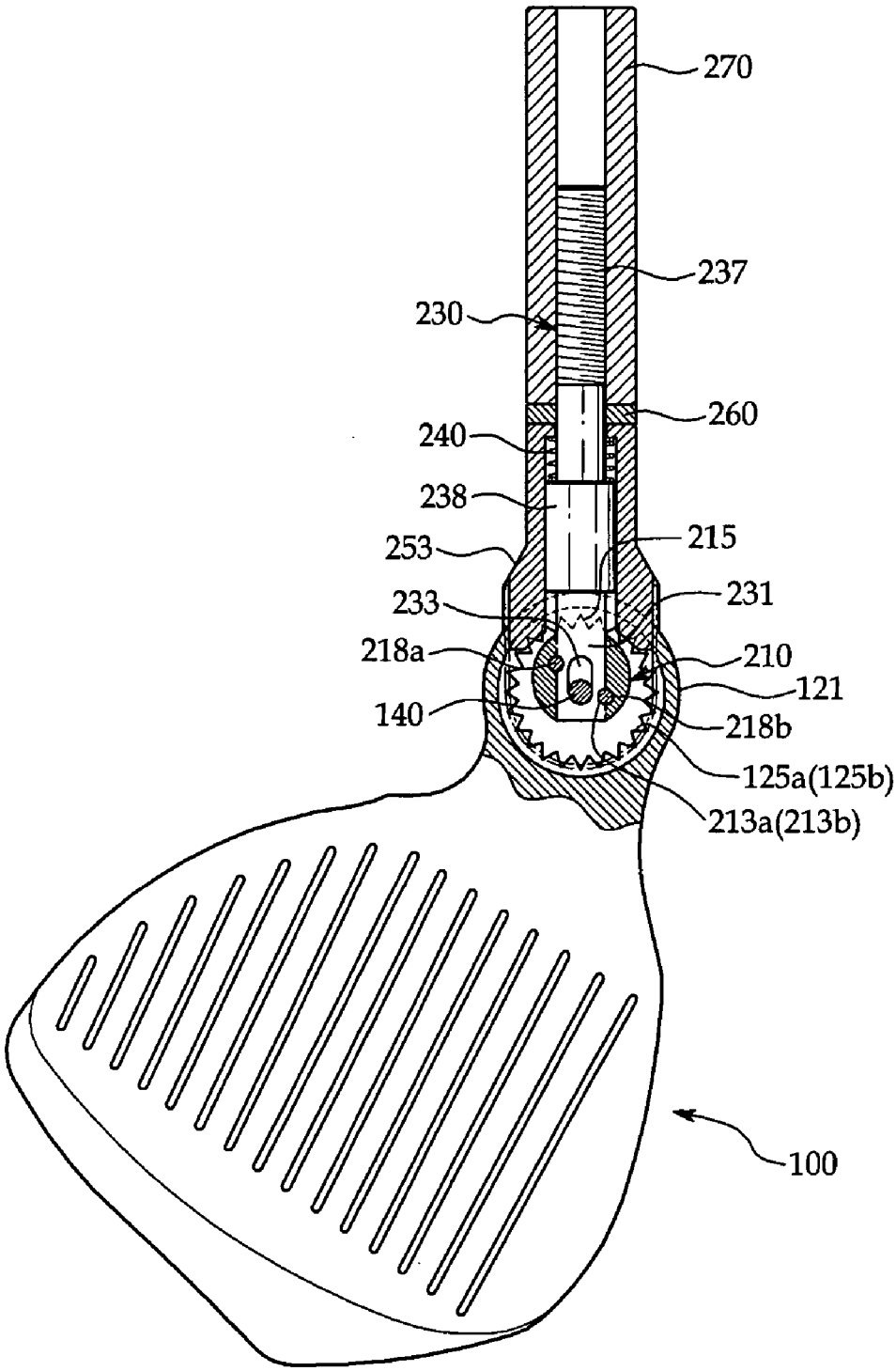
Figure 6A:
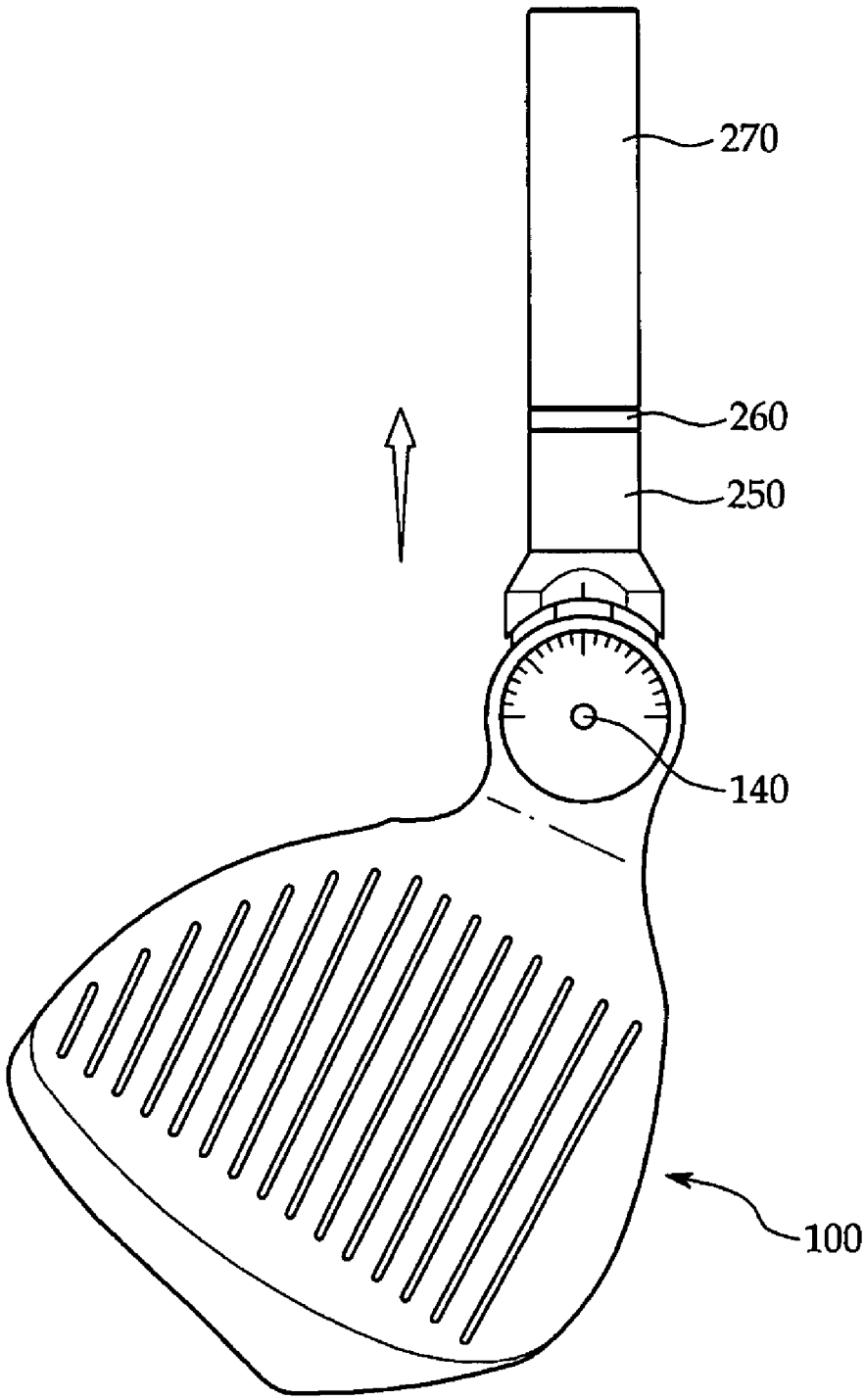
FIGS. 6*a* and 6*b* are partly cut sectional views showing a state where an adjusting tube is moved backwardly, in the golf club configured according to the first embodiment of the present invention.
Figure 6B:
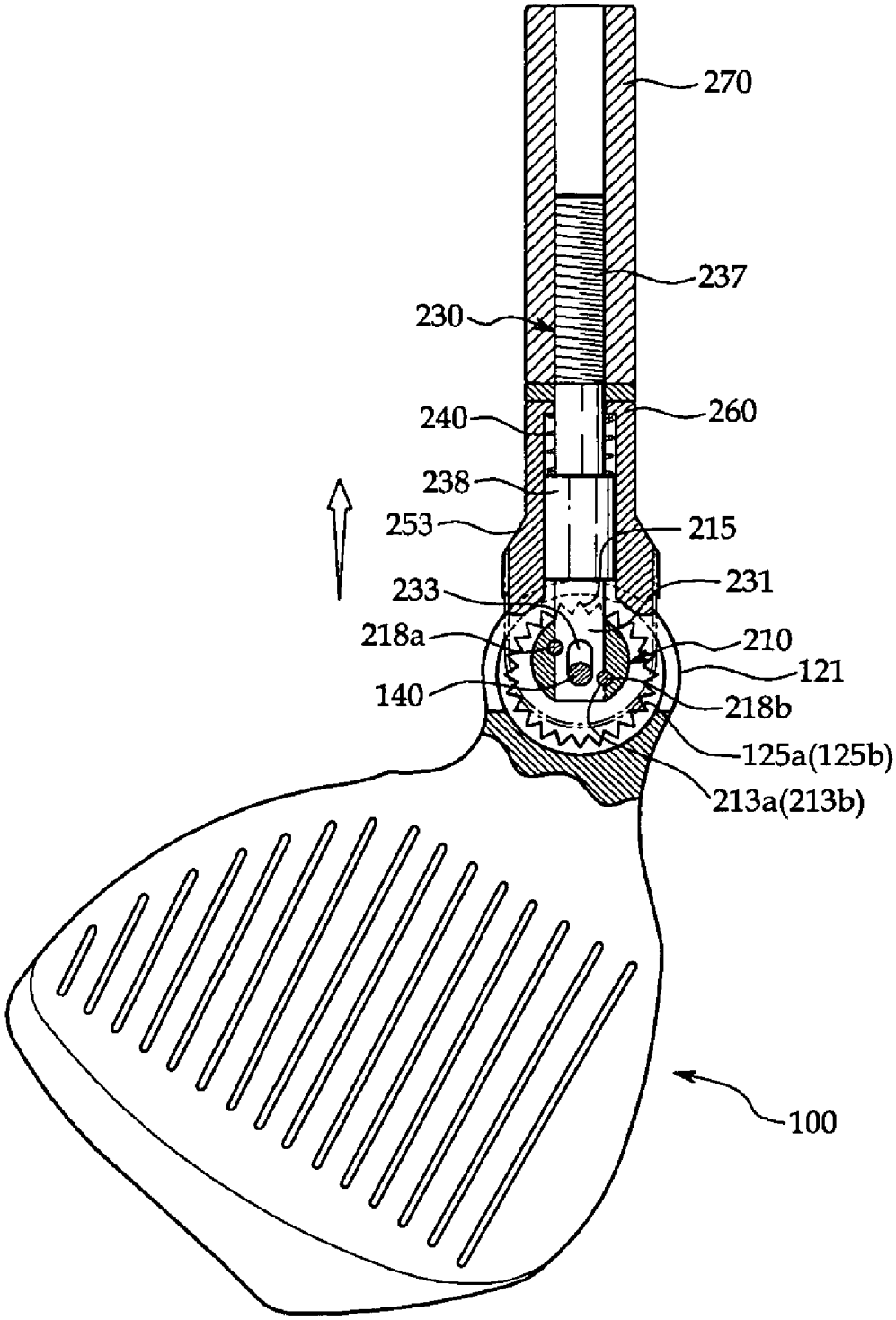
Figure 7A:
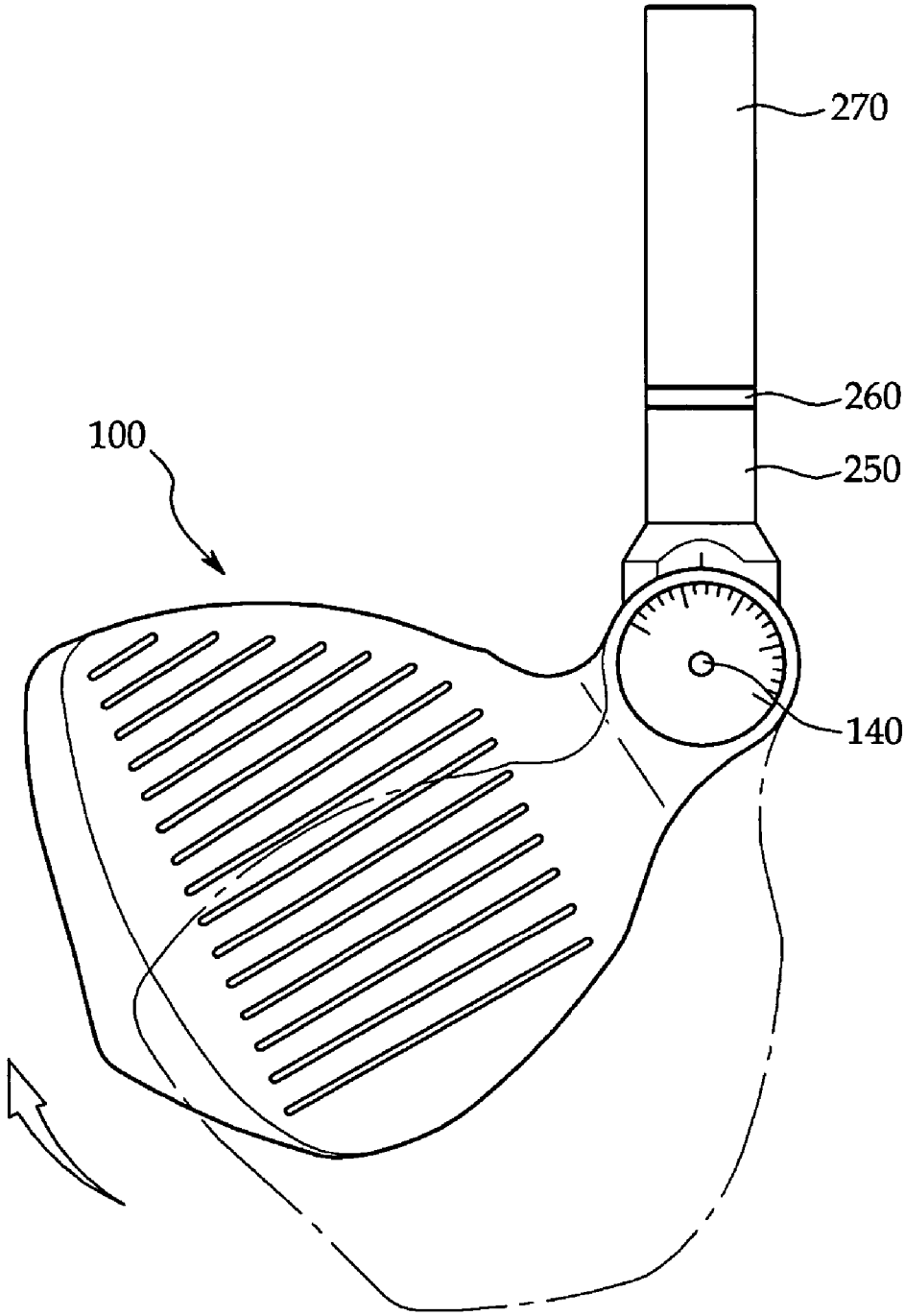
FIGS. 7*a* and 7*b* are partly cut sectional views showing a state where the loft angle of the head portion is varied, in the golf club configured according to the first embodiment of the present invention.
Figure 7B:
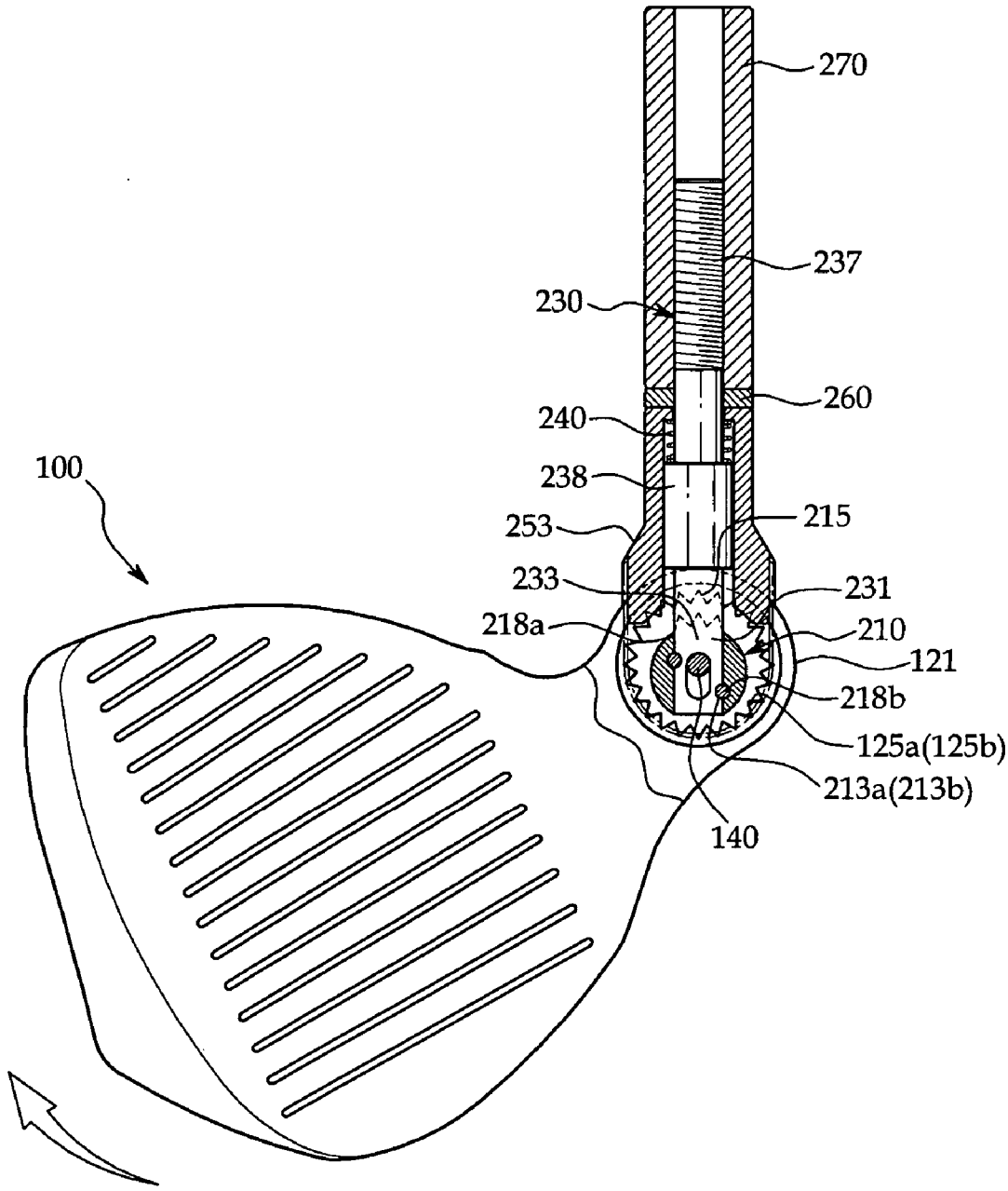

Now, an explanation of the operation and function of the golf club head having a variable loft angle according to the first embodiment of the present invention. FIGS. 5*a* and 5*b* are partly cut sectional views showing an operation where the head portion is fixed at a given loft angle, in the golf club configured according to the first embodiment of the present invention, FIGS. 6*a* and 6*b* are partly cut sectional views showing a state where an adjusting tube is moved backwardly, in the golf club configured according to the first embodiment of the present invention, and FIGS. 7*a* and 7*b* are partly cut sectional views showing a state where the loft angle of the head portion is varied, in the golf club configured according to the first embodiment of the present invention.

The adjusting tube 270 is rotated in a clockwise direction such that the loft angle of the head portion 100 is varied. That is to say, when the adjusting tube 270 is rotated in the clockwise direction, the male screw of the adjusting tube 270 is unfastened from the male screw portion 237 of the fastening bar 230 such that the adjusting tube 270 is moved backwardly.

When the adjusting tube 270 is moved backwardly, the hollow fastening tube 250 that is mounted to the head heel pieces 121*a* and 121*b* of the head heel 120 is moved backwardly by the elastic force of the spring 240 depressed in the inside of the hollow fastening tube 250, being in close contact with the adjusting tube 270, thereby forming a given distance from the head heel 120. If the adjusting tube 270 pushes toward the head heel 120 in the state where the head heel 120 is separated by the given distance from the hollow fastening tube 250, the whole fastening portion 200 pushes. This is possible because the first through hole 211 of the rotary body 210 is formed longitudinally. At this time, an engaged state between the outer gear pieces 215*a* and 215*b* of the rotary body 210 that are connected with the end portion of the fastening bar 230 and the inner gears 125*a* and 125*b* of the head heel 120 is released.

When the engagement is released, the rotary body 210 can be rotated with respect to the shaft pin 140 such that the fastening bar 230 that is connected to the rotary body 210 and covered with the hollow fastening tube 250 thereon is rotated along the guide recess 130 on the head heel 120, which makes it possible to adjust the angle range between the coupling portion 200 and the head portion 100. At this time, the formation of the guide protrusions 255*a* and 255*b* on the end portion of the hollow fastening tube 250 enables the fastening bar 230 to be rotated in a more stable manner.

So as to fix the head portion 100 at a desired angle by the rotation of the fastening portion 200, the adjusting tube 270 is rotated in a counter-clockwise direction. Thereby, the adjusting tube 270 is moved to the head portion 100 side thus to push the hollow fastening tube 250 to the head portion 100 side, and the given distance between the head heel 120 and the hollow fastening tube 250 disappears. As a result, the outer gear pieces 215*a* and 215*b* of the rotary body 210 are engaged with the inner gears 125*a* and 125*b* of the rotary grooves 123*a* and 123*b*, thereby fixing the fastening portion 200, without further rotation.

Figure 8:
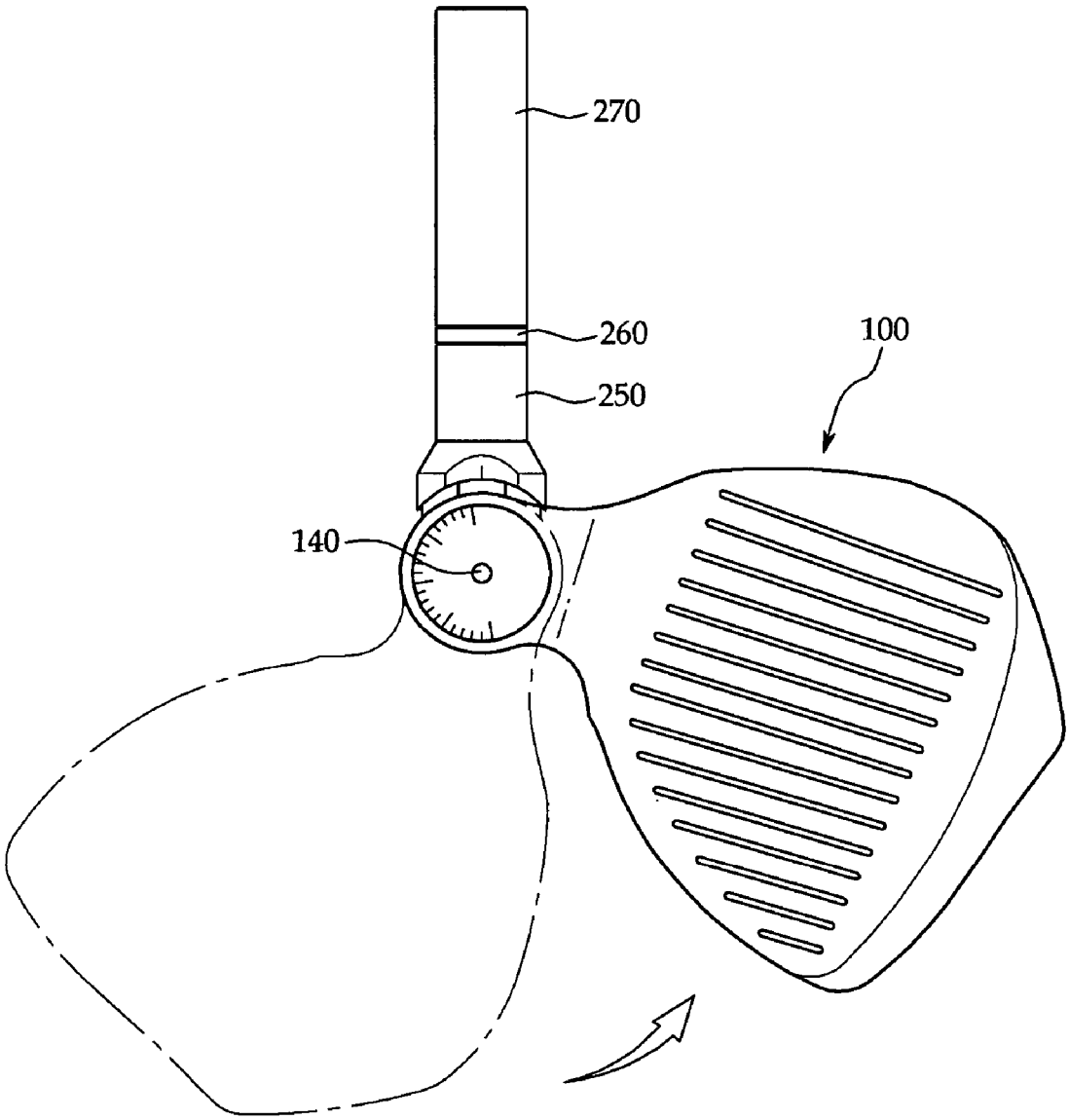
FIG. 8 is a view showing an operation where the head portion is turned over a loft angle of 90°, in the golf club configured according to the first embodiment of the present invention.

On the other hand, FIG. 8 is a view showing an operation where the head portion 100 is rotated over a loft angle of 90°, in the golf club configured according to the first embodiment of the present invention. At this time, the golf club head is that for a left-handed golfer, and thus, it is very useful when the golfer strikes a golf ball, standing in a left direction with respect to the position of the golf ball due to unavoidable obstacles.

Next, an explanation of a method of assembling the golf club head according to the first embodiment of the present invention will be given hereinafter.

The head portion 100 having the head heel 120 and the head body 110 formed as a unitary body is placed to a position to be assembled, and the protecting band 220 is inserted into the guide recess 130. Next, the rotary body 210 is mounted between the rotary holes 123*a* and 123*b* formed at the wall surfaces of the guide recess 130, through the rotary hole 123*a* that is opened to the outside, and the fastening bar 230 is fittably inserted into the insertion recess 217 of the rotary body 210. Next, the first through hole 211 and the second through hole 233 are placed to correspond to each other, and the fixing holes 213*a* and 213*b* and the fixing grooves 235*a* and 235*b* are placed to correspond to one another. After that, the fixing pins 218*a* and 218*b* are passed through the fixing holes 213*a* and 213*b* and the fixing grooves 235*a* and 235*b* such that the fastening bar 230 is coupled to the rotary body 210. Next, the fastening bar 230 is coupled to the spring 240 on the outer periphery thereof and covered with the hollow fastening tube 250 at the upper portion thereof by fittably inserting the guide protrusions 255*a* and 255*b* into the guide recess 130. The hollow fastening tube 250 is provided with the washer 260 that is disposed on the top surface thereof and the adjusting tube 270 that is disposed on the outer periphery thereof. At this time, the adjusting tube 270 is screw-coupled with the male screw portion 237 of the fastening bar 230. At a final step, the cover 150 is disposed on the rotary holes 123*a*, and the shaft pin 140 is passed through the shaft hole 151 on the cover 150, the first through hole 211 of the rotary body 210, the second through hole 233 of the fastening bar 230, and the shaft hole 127 of the head heel piece 121*b* in the order as described above such that the head portion 100, the rotary body 210, and the fastening bar 230 are all fixed to one another.

Figure 9:
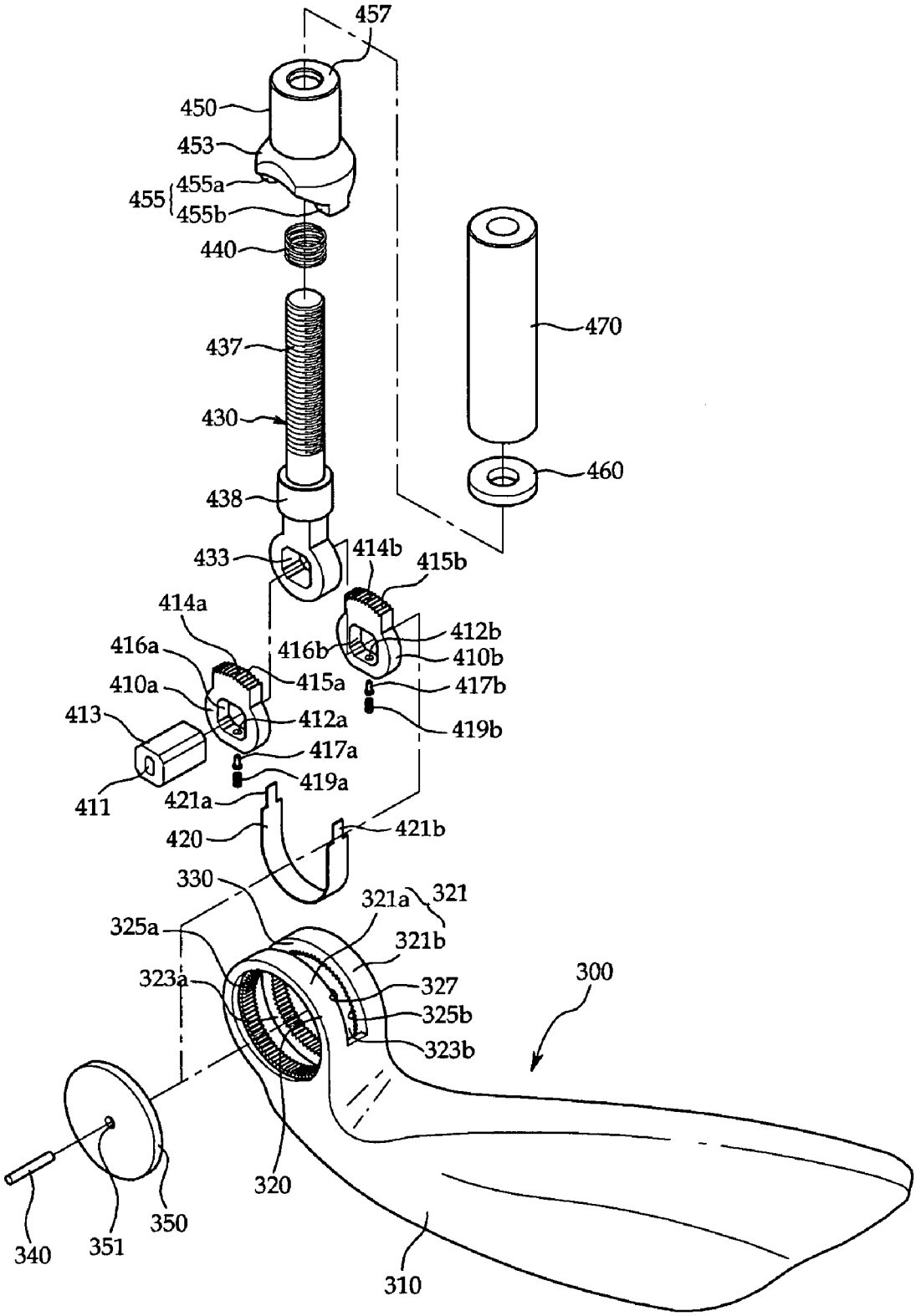
FIG. 9 is an exploded perspective view of a golf club head having a variable loft angle according to a second embodiment of the present invention.
Figure 10:
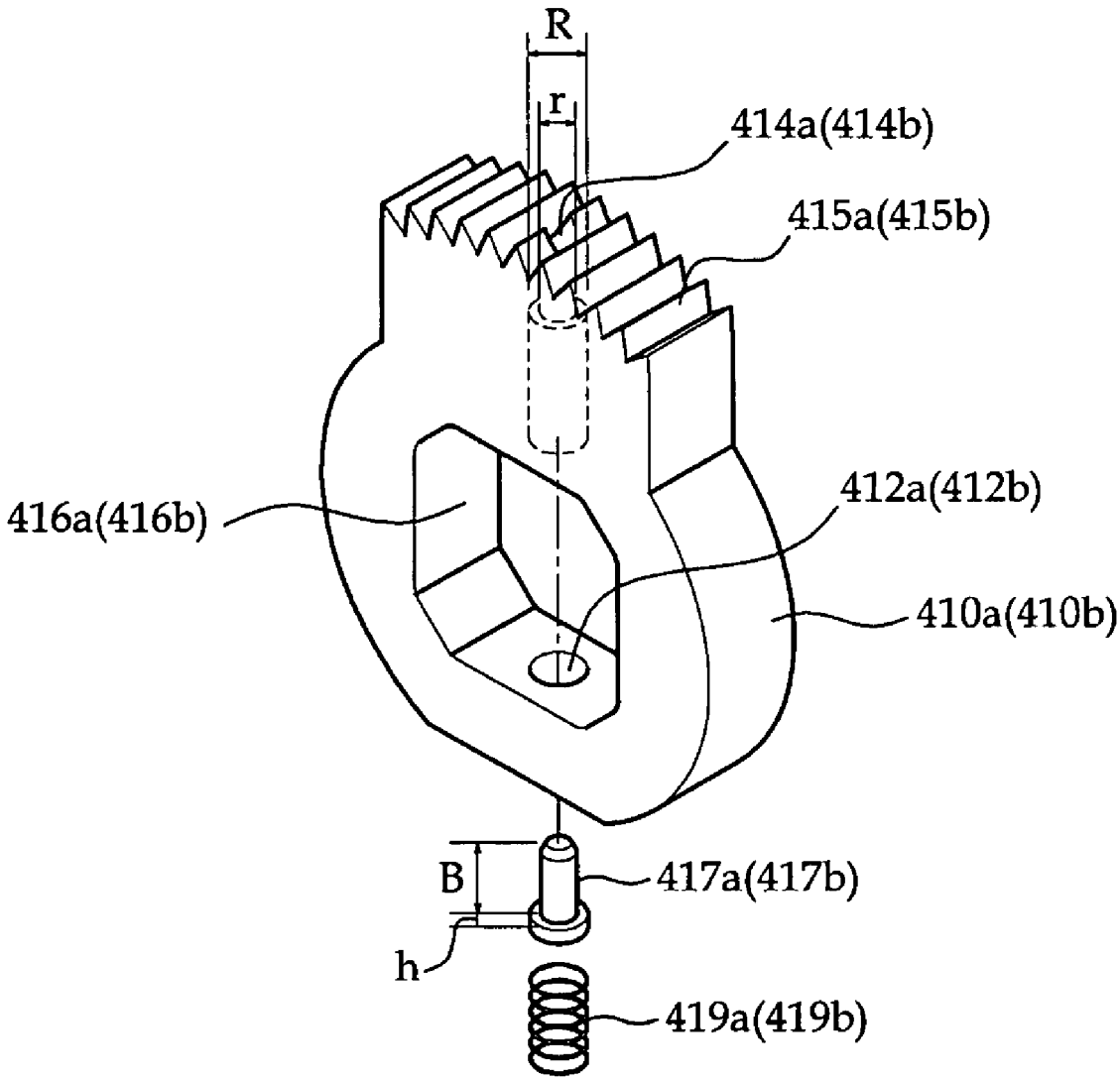
FIG. 10 is an enlarged and exploded perspective view of a rotary body of the golf club head of FIG. 9.
Figure 11:
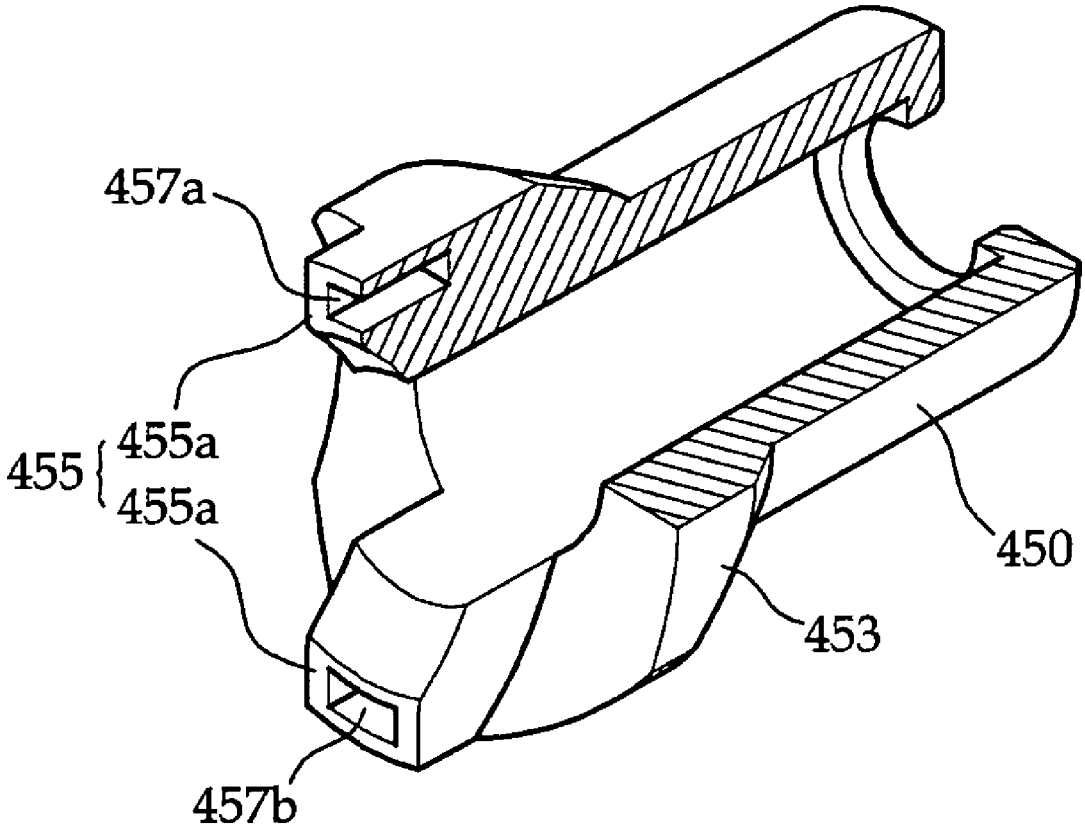
FIG. 11 is a cut perspective view of a hollow fastening tube of the golf club head of FIG. 9.

Now, an explanation of a configuration of the golf head club having a variable loft angle according to a second embodiment of the present invention is given in detail with reference to FIGS. 9 and 11. In the second embodiment of the present invention, the changes in the shapes of the rotary body and the fastening bar and in the method of coupling the protecting band are made in easier and simpler manner than the first embodiment of the present invention, and a click is generated upon adjustment of loft angles such that a golfer can sense the rotation. FIG. 9 is an exploded perspective view of a golf club head having a variable loft angle according to a second embodiment of the present invention, FIG. 10 is an enlarged and exploded perspective view of a rotary body of the golf club head of FIG. 9, and FIG. 11 is a cut perspective view of a hollow fastening tube of the golf club head of FIG. 9. In this second embodiment of the present invention, a rotary body includes rotary pieces 410*a* and 410*b* and a coupling pin 413 that couples the rotary pieces 410*a* and 410*b* with a fastening bar 430.

The coupling pin 413 is formed of a polygonal post body having a cross section in a polygonal shape such that it is not rotated. The coupling pin 413 as shown in FIG. 9 has a square shape formed cut at its edge portions. Also, the coupling pin 413 has a first through hole 411 through which a shaft pin 340 is passed formed axially at the central portion thereof.

The rotary pieces 410*a* and 410*b* are provided with first coupling holes 416*a* and 416*b* through which the coupling pin 413 is fittably passed that are formed to correspond to the cross section shape of the coupling pin 413 and with outer gear pieces 415*a* and 415*b* that are formed at the outer peripheral surfaces thereof. As a result, the rotary pieces 410*a* and 410*b* has a shape of a generally round ring. The rotary pieces 410*a* and 410*b* are also provided with pin holes 414*a* and 414*b* that are passed through the outer gear pieces 415*a* and 415*b* and the first coupling holes 416*a* and 416*b*. In this case, the pin holes 414*a* and 414*b* have two sizes in diameters, wherein they have a large diameter R at the first coupling holes 416*a* and 416*b* side and they have a smaller diameter r than the diameter R, at the outer gear pieces 415*a* and 415*b* side. Thus, the pin holes 414*a* and 414*b* are configured such that bodies B of small pins 417*a* and 417*b* are passed therethrough and head portions h thereof are not inserted thereinto. Namely, if the bodies B of the small pins 417*a* and 417*b* are forcedly inserted toward the outer gear pieces 415*a* and 415*b* side, only predetermined portions of the bodies B are exposed through the first coupling holes 416*a* and 416*b* and are not deviated by means of the head portions h thereof. After mounting the small pins 417*a* and 417*b*, small springs 419*a* and 419*b* are disposed around the outer peripheries of the small pins 417*a* and 417*b*. So as to allow the easy insertion of the small pins 417*a* and 417*b* and the small springs 419*a* and 419*b*, on the other hand, the rotary pieces 410*a* and 410*b* are provided with insertion holes 412*a* and 412*b* that are additionally formed on the bottom surfaces thereof.

The fastening bar 430 is provided with a second coupling hole 433 that has the same shape as each of the first coupling holes 416*a* and 416*b*, at the end portion thereof located at the rotary body side. Therefore, the coupling pin 413 that is passed through the first coupling holes 416*a* and 416*b* and the second coupling hole 433 connects the rotary body and the fastening bar 430.

In the second embodiment of the present invention, a protecting band 420 is provided with both end portions 421*a* and 421*b* that are inserted into insertion grooves 457*a* and 457*b* formed on the guide protrusions of the hollow fastening tube.

On the other hand, each of the inner gears 325*a* and 325*b* has 72 gear threads. In this case, the more the number of gear threads is, the smoother the rotation of inner gears is. Each of gear threads causes the rotation of about 5°, which provides the convenience in the adjustment of angle. It is easy to have a plurality of gear threads in the second embodiment of the present invention, when compared to the first embodiment of the present invention.

Another parts in the second embodiment of the present invention are configured in a similar manner to the first embodiment of the present invention, and an explanation of them is avoided for the brevity of the description.

Figure 12A:
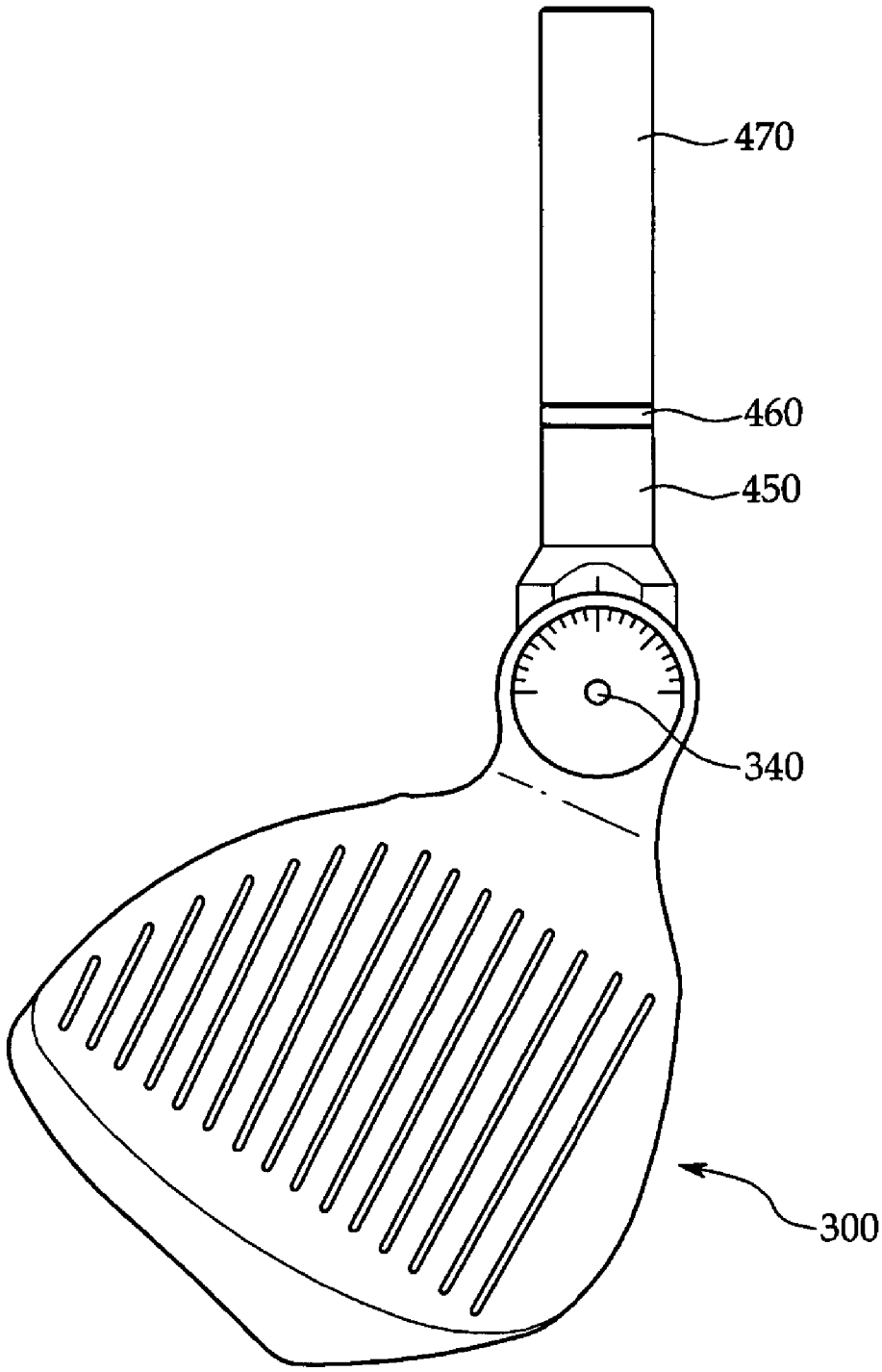
FIGS. 12*a* and 12*b* are partly cut sectional views showing an operation where the head portion is fixed at a given loft angle, in the golf club configured according to the second embodiment of the present invention.
Figure 12B:
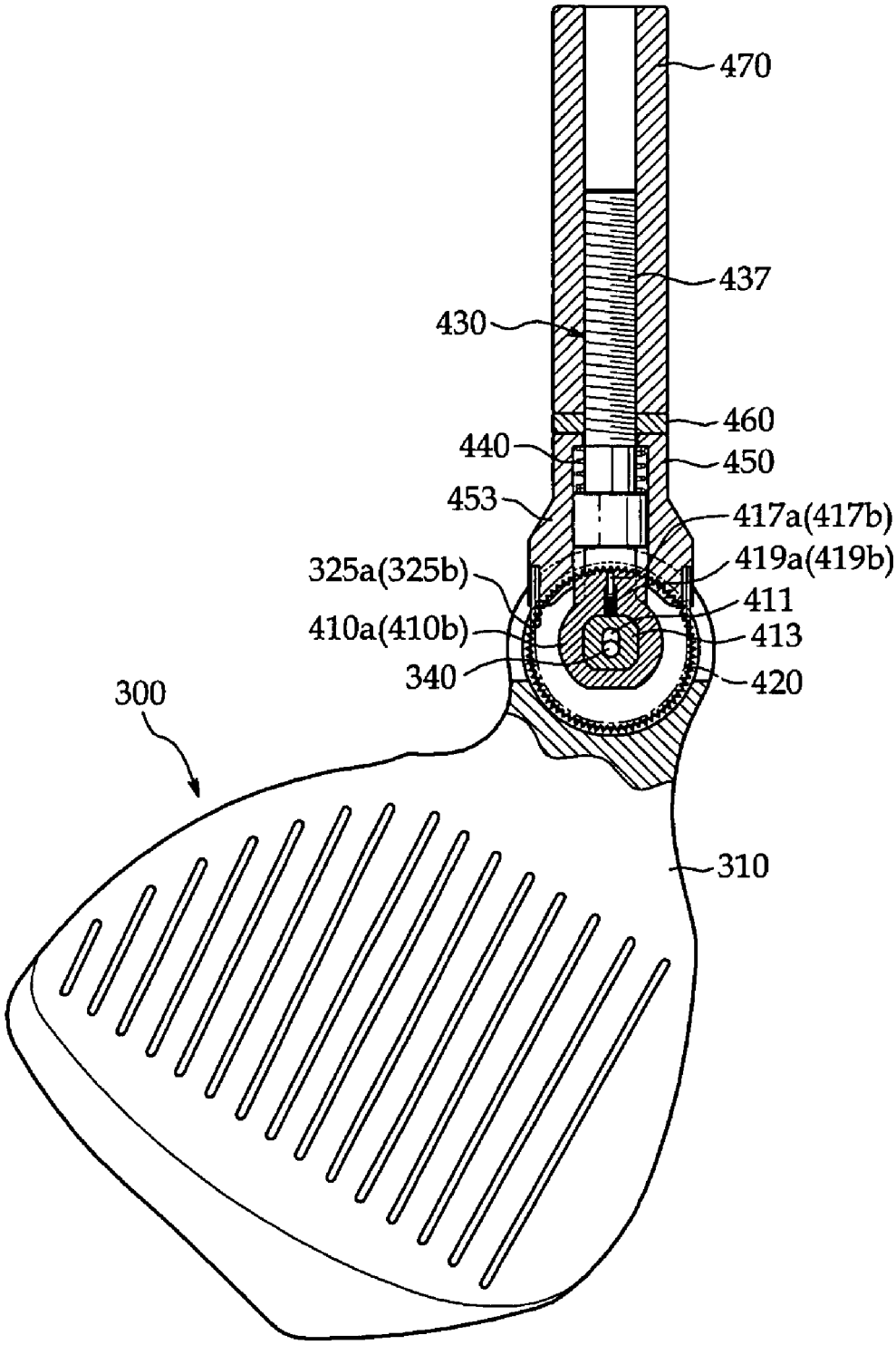
Figure 13A:
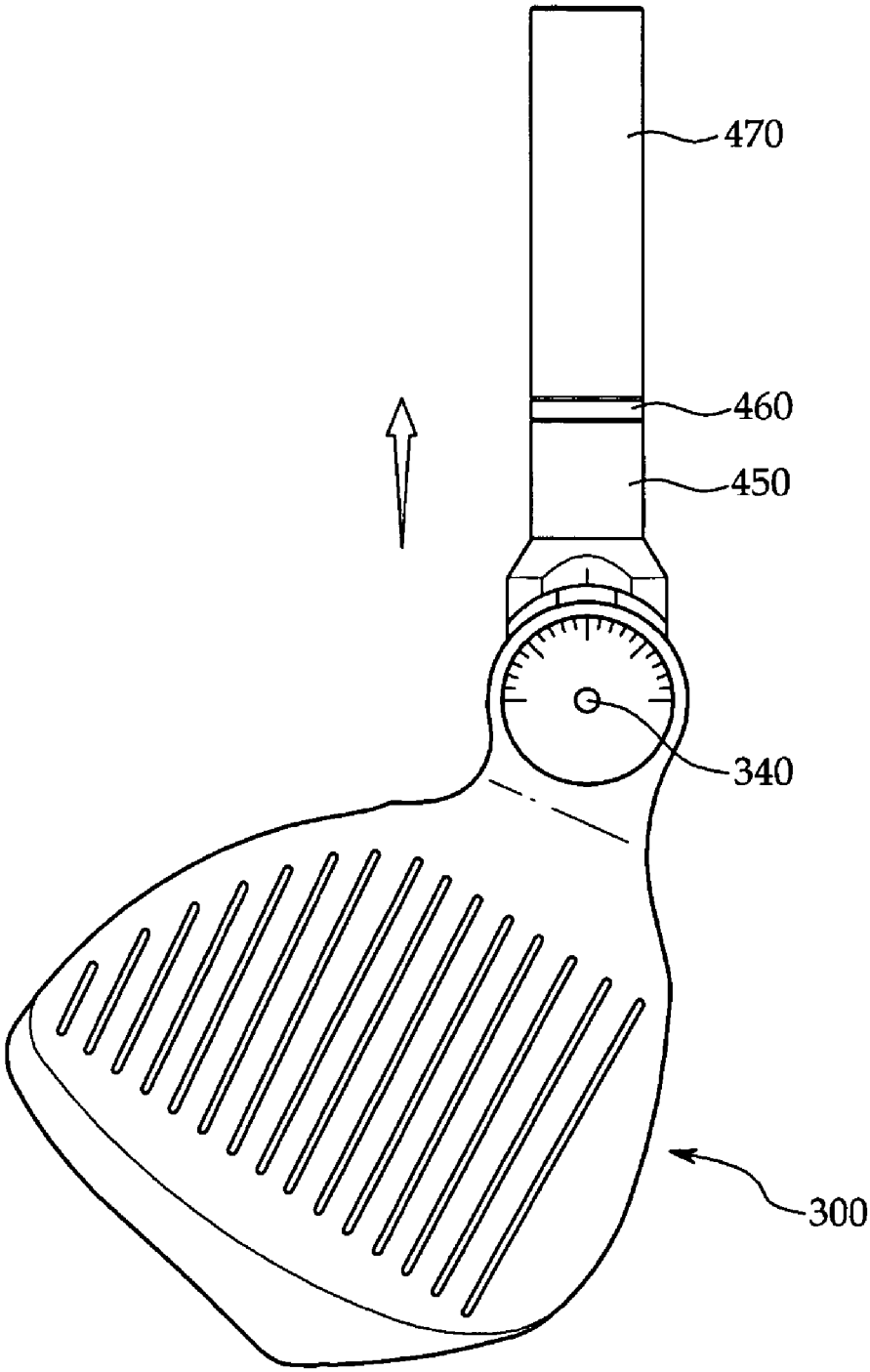
FIGS. 13*a* and 13*b* are partly cut sectional views showing a state where an adjusting tube is moved backwardly, in the golf club configured according to the second embodiment of the present invention.
Figure 13B:
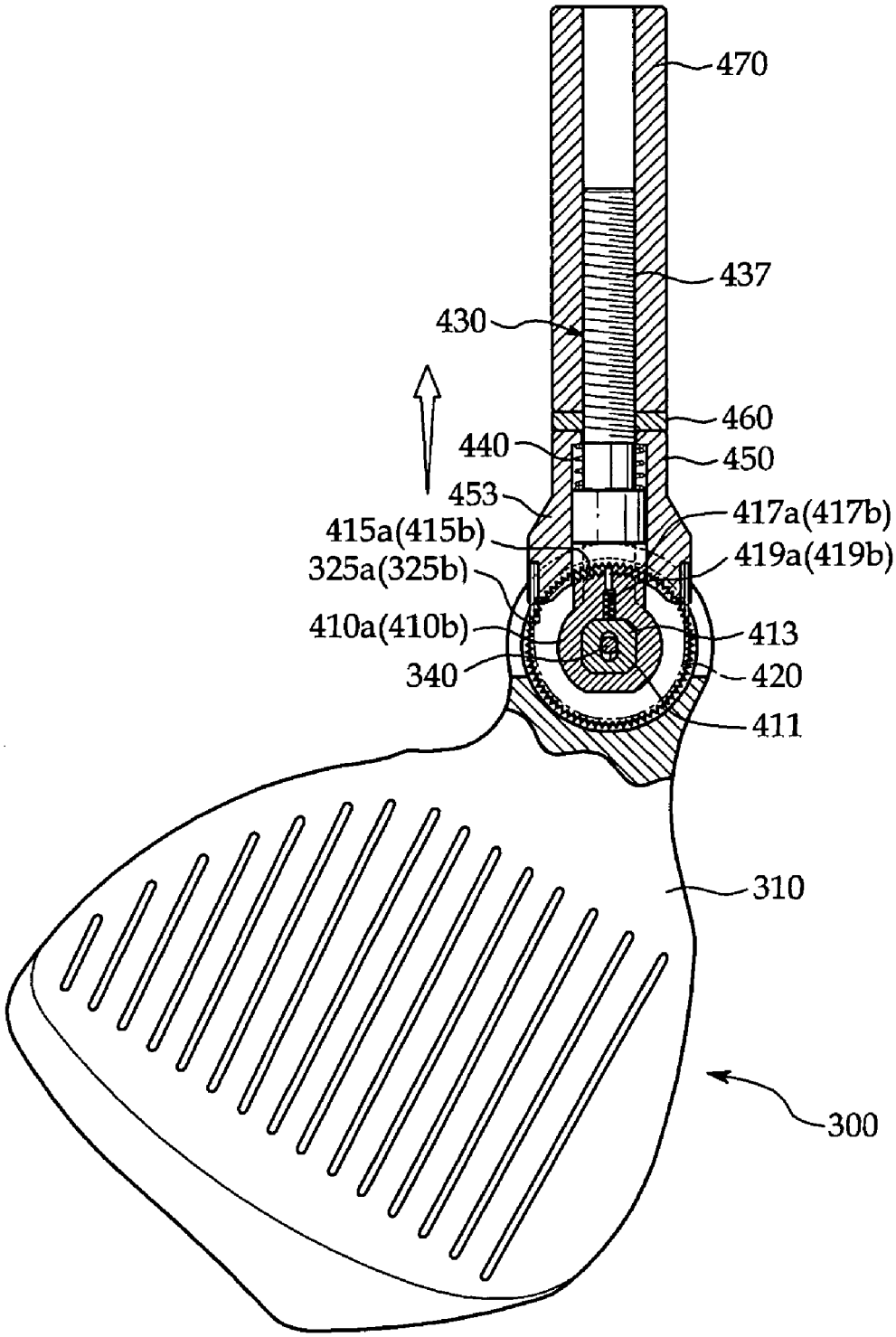
Figure 14A:
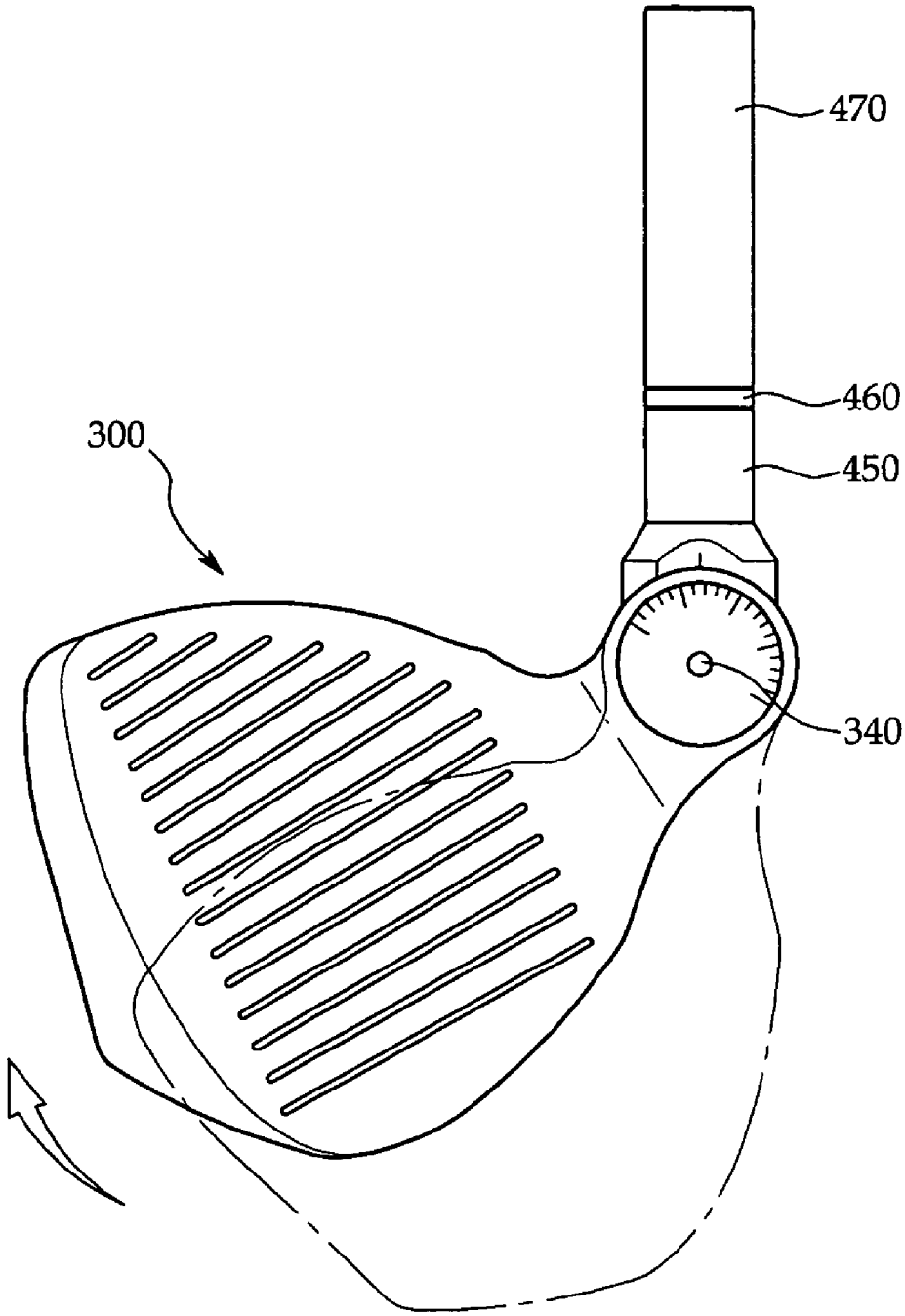
FIGS. 14*a* and 14*b* are partly cut sectional views showing a state where the head portion is rotated to vary the loft angle, in the golf club configured according to the second embodiment of the present invention.
Figure 14B:
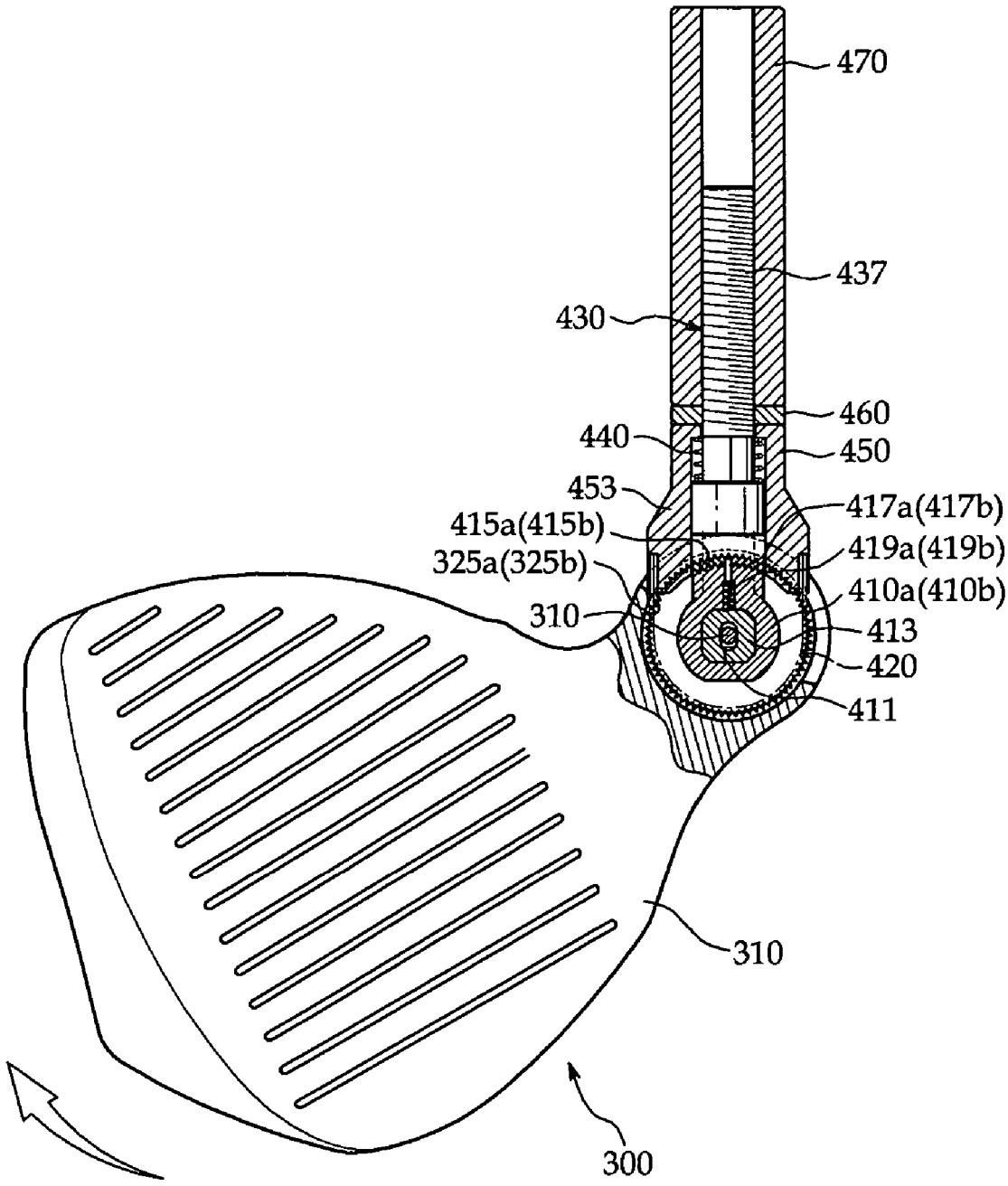

FIGS. 12*a* and 12*b* are partly cut sectional views showing an operation where the head portion is fixed at a given loft angle, in the golf club configured according to the second embodiment of the present invention, FIGS. 13*a* and 13*b* are partly cut sectional views showing a state where an adjusting tube is moved backwardly, in the golf club configured according to the second embodiment of the present invention, and FIGS. 14*a* and 14*b* are partly cut sectional views showing a state where the head portion is turned to vary the loft angle, in the golf club configured according to the second embodiment of the present invention.

The second embodiment of the present invention is similar to the first embodiment, except that the operations of the small pins 417*a* and 417*b* and the small springs 419*a* and 419*b*, and an explanation on the same operation in the second embodiment as the first embodiment is avoided below. Accordingly, an explanation of the operations of the small pins 417*a* and 417*b* and the small springs 419*a* and 419*b* is given in detail below.

An adjusting tube 470 is moved such that the outer gear pieces 415*a* and 415*b* are separated from the inner gears 325*a* and 325*b*, and after that, if the rotary body is rotated, the small pins 417*a* and 417*b* that are pressed by means of the inner gears 325*a* and 325*b* come up and down repeatedly with respect to the gear threads formed on the inner gears 325*a* and 325*b*, thereby generating clicks. Even though a golfer does not observe the marks on the head heel portion, he or she can sense that whenever a click is generated, the loft angle of the head portion is rotated by about 5°.

Next, an explanation of a method of assembling the golf club head according to the second embodiment of the present invention is given below.

First, the small pins 417*a* and 417*b* are passed through the insertion holes 412*a* and 412*b* and then inserted into the pin holes 414*a* and 414*b* in such a manner where the bodies B thereof are located toward the outer gear pieces 415*a* and 415*b*. Next, the small springs 419*a* and 419*b* are disposed around the outer peripheries of the small pins 417*a* and 417*b*, thereby finishing assembling the rotary pieces 410*a* and 410*b*.

Next, the threads of the outer gear pieces 415*a* and 415*b* of the rotary pieces 410*a* and 410*b* are engaged with the inner gears 325*a* and 325*b* of the rotary holes 323*a* and 323*b* in such a manner as to be located toward the guide recess 330 side. The fastening bar 430 is inserted into the guide recess 330 such that the second coupling hole 433 is located to correspond to the second coupling hole 416*b* of the rotary piece 410*b* and also to correspond to the first coupling hole 416*a* of the rotary piece 410*a*. When the coupling pin 413 is passed through the coupling holes 416*a* and 416*b* of the fastening bar 430 in the state where the rotary pieces 410*a* and 410*b* and the coupling holes 416*a* and 416*b* are arranged to correspond to one another, the fastening bar 430 and the rotary body are assembled.

On the other hand, the end portions 421*a* and 421*b* of the protecting band 420 are inserted into the insertion grooves 457*a* and 457*b*, without any welding process. The method of assembling the parts after the fastening bar 430 and the rotary body are assembled is the same as in the first embodiment of the present invention, and an explanation of it is omitted below.

While the present invention has been described with reference to the particular illustrative embodiments, it is not to be restricted by the embodiments but only by the appended claims, and therefore, it is to be understood that other modifications and variations may be made without departing from the substance and scope of the present invention. For example, it is possible to change the shapes of the head heel and the outer gear pieces, to replace the spring with another elastic member, and to change the shapes of the various pins and holes, which is of course obvious to those skilled in the art.

The golf club head according to the present invention can vary the loft angle according to the rotation of the head portion, thereby achieving different loft angles with one golf club. According to the present invention, even though a golfer does not have a full set of golf clubs, he or she can enjoy doing the golf in a more convenient manner.

More specifically, in a case where the golf club head of the present invention is applied on the wedge, a golfer does not need to carry all wedges inclusive of a sand wedge that is not often used.

Furthermore, in the case where the head portion of the golf club head according to the present invention is rotated over the loft angle of 90°, it is changed for a left-handed golfer such that it is very useful when the golfer strikes a ball, standing in a left direction with respect to the position of the ball due to unavoidable obstacles.

Also, the golf club head according to the present invention can select a desired loft angle with ease, and it has enough rigidity to maintain its performance, even though the head portion is designed to rotate.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A golf club head having a variable loft angle, connected to a shaft of a golf club, the golf club head comprising:

a head portion having a head body for striking a golf ball and a head heel extending upwardly from one side of the head body and bent at a given angle; and a fastening portion extending to the shaft and having a rotary assembly rotating with respect to the head portion and a fixing assembly for fixing the head portion to a position at which a given loft angle is selected, wherein the head heel comprises:

a guide recess extended to left and right directions from a central portion of an end portion thereof;

a pair of head heel pieces formed by placing the guide recess there-between; the head heel pieces having a pair of inner gears along an inner peripheral surfaces thereof and a pair of rotary holes formed on the pair of head heel pieces to communicate with the guide recess, one of the pair of rotary holes opened to the outside and the other having a given diameter of shaft hole formed on the bottom surface thereof, and the fastening portion comprises:

a rotary body formed of a hollow cylindrical body and provided with an insertion recess formed at the side portion thereof, a pair of outer gear pieces formed at the both sides of the insertion recess to be engaged with the inner gears, and a first through hole formed in a length direction thereof to be passed through the both end portions thereof, each of the inner gears having a height higher than the first through hole;

a fastening bar having a second through hole formed to correspond with the first through hole at one end portion thereof, the second through hole fittably inserted into the insertion recess of the rotary body, and having a male screw portion formed at the other end portion thereof;

a hollow fastening tube disposed around the outer periphery of the fastening bar, the hollow fastening tube having a given length where the male screw portion of the fastening bar is exposed; and an adjusting tube having a female screw coupled to the male screw portion formed on the inner periphery thereof, the adjusting tube disposed on the outer periphery of the fastening bar, located to be adjacent to the hollow fastening tube, and connected to the shaft of the golf club, whereby the head portion and the fastening portion are rotated with respect to each other by means of a shaft pin that is passed through the shaft hole, the first through hole and the second through hole.

2. A golf club head having a variable loft angle according to claim 1, wherein the head heel further comprises a cover provided with a shaft hole having the same size as the shaft hole of the rotary hole at a central portion thereof.

3. A golf club head having a variable loft angle according to claim 1, wherein the fastening bar is provided with a spring located on the outer periphery thereof and with a spring fixing member located at one section of the fastening bar, for fixing the position of the spring.

4. A golf club head having a variable loft angle according to claim 3, wherein the end portions of the head heel pieces are rounded such that an end portion of the hollow fastening tube located to the head heel side is rounded concavely, facing the rounded end portions of the head heel pieces.

5. A golf club head having a variable loft angle according to claim 4, wherein the hollow fastening tube comprises a pair of guide protrusions fittably disposed to the guide recess at one end portion thereof located to the head heel side, for facilitating the rotation of the fastening portion on the head portion.

6. A golf club head having a variable loft angle according to claim 5, wherein only one heel piece has marks on the side opposite the cover for indicating the angles of the head portion.

7. A golf club head having a variable loft angle according to claim 6, wherein the male screw portion is formed with left-handed threads.

8. A golf club head having a variable loft angle according to claim 7, wherein the fastening portion comprises a protecting band disposed along the inner peripheral surface of the guide recess, for preventing dusts and foreign materials from gathering into the guide recess.

9. A golf club head having a variable loft angle according to claim 1, wherein the fastening portion comprises a washer located between the adjusting tube and the hollow fastening tube.

10. A golf club head having a variable loft angle according to claim 1, wherein the rotary body comprises at least one or more fixing holes that are passed through the both end portions thereof in a perpendicular direction to the insertion recess, the fastening bar comprises fixing grooves that are formed correspondingly to the fixing holes at the end portion thereof located to the rotary body side, and the rotary body comprises fixing pins that are passed through the fixing holes of the rotary body and the fixing grooves of the fastening bar, for connecting the rotary body and the fastening bar.

11. A golf club head having a variable loft angle according to claim 1, wherein the rotary body comprises:

a coupling pin formed of a post body having a cross section in a polygonal shape and having a first through hole formed axially to be passed through the both end portions thereof at the central portion thereof, the first through hole having a higher height than each of the inner gears; and a pair of rotary pieces formed of a generally round ring having a given thickness and protruded outwardly from one side thereof and provided at the central portion thereof with first coupling holes through which the coupling pin is forcedly fitted and with outer gear pieces formed at the end portion of the protruded sides thereof, for engaging with the inner gears, and the fastening bar comprises a second coupling hole formed at one end portion thereof, the second coupling hole having the same shape as the first coupling hole, such that the connection of the rotary body and the fastening bar is made by means of the coupling pin that is passed through the first coupling hole and the second coupling hole.

12. A golf club head having a variable loft angle according to claim 11, wherein the rotary pieces comprise pin holes each having a large diameter (R) at the first coupling holes side and a smaller diameter (r) than the diameter (R) at the outer gear pieces side, small pins inserted into the pin holes and having head portions (h) larger than the smaller diameter (r) of the pin hole and bodies (B) located toward the outer gear pieces, and elastic members depressed against the head portions (h) of the small pins.

13. A golf club head having a variable loft angle according to claim 11, wherein each of the inner gears has about 72 gear threads, each of gear threads causing the rotation of about 5°.

* * * * *